United States Patent [19]

Steimel

[11] Patent Number: 4,479,789

[45] Date of Patent: Oct. 30, 1984

[54] BELL-LIKE CENTRIFUGE DRUM FOR CONTINUOUSLY FREEING METAL TURNINGS OF OIL

[76] Inventor: Richard Steimel, Frankfurter Strasse 134, 5202 Hennef, Fed. Rep. of Germany

[21] Appl. No.: 414,376

[22] PCT Filed: Mar. 11, 1982

[86] PCT No.: PCT/EP82/00048

§ 371 Date: Aug. 30, 1982

§ 102(e) Date: Aug. 30, 1982

[87] PCT Pub. No.: WO82/03189

PCT Pub. Date: Sep. 30, 1982

[51] Int. Cl.[3] ..... B04B 1/10

[52] U.S. Cl. ..... 494/43; 494/56; 494/64; 494/901

[58] Field of Search ..... 494/56, 57, 85, 901, 494/60, 64, 43, 81

[56] References Cited

U.S. PATENT DOCUMENTS

| | | | |
|---|---|---|---|
| 336,324 | 2/1886 | Johansson | 494/56 X |
| 1,776,554 | 9/1930 | Gale | 494/901 X |
| 3,989,184 | 11/1976 | Albishausen | 494/43 |
| 4,143,806 | 3/1979 | Moriguchi | 494/901 X |

FOREIGN PATENT DOCUMENTS

| | | | |
|---|---|---|---|
| 2031308 | 4/1980 | United Kingdom | 494/56 |
| 0628957 | 9/1978 | U.S.S.R. | 494/56 |

*Primary Examiner*—Robert W. Jenkins

*Attorney, Agent, or Firm*—Michael J. Striker

[57] ABSTRACT

The present invention is with respect to a bell-like centrifuge drum for freeing metal turnings of oil continuously and which is made up of a lower drum part (1) with a floor (2) and a coned wall part (3), at whose top edge an outwardly running flange (4) is placed and an upper drum part (5) at whose lower edge there is again an outwardly running flange (6), which, producing a gap (10) for letting off liquid to be cleared from the turnings, is fixed on the flange (4) of the lower drum part (1). To make it simpler for the oil let-off openings of the centrifugal drum to be more readily kept free and more quickly cleaned of waste material, in the invention the gap (10) is designed stretching as far as the inner face (9) of the drum wall and conically becoming wider from the inner face (9) of the drum wall to the outer face (11) of the drum wall and the clearance diameter of the top edge (12), present at the inner face (9) of the drum wall, of the gap (10) is greater than the clearance diameter of the lower edge (13), present at the lower drum part (1), of the gap (10).

14 Claims, 3 Drawing Figures

BELL-LIKE CENTRIFUGE DRUM FOR CONTINUOUSLY FREEING METAL TURNINGS OF OIL

The present invention is with respect to a bell-like centrifuge drum for continuously freeing metal turnings of oil as noted in the preamble of claim 1. Such a centrifuge drum has been put forward in the prior art, see German Pat. No. 1,226,793.

In the case of the known centrifuge drum the outlet openings for the liquid to be separated from the turnings are formed by the holes of a finely perforated, ring-like sheet metal sieve, which is placed at the inner face of the drum wall on the inner side of the gap between the two flanges, which are screwed together, of the two drum parts. For fixing the size of the gap, distance washers are placed between the flanges. The sheet metal sieve which is placed in openings of the same form on the inner side of the drum wall has the function of covering up the gap. This design of a centrifuge drum has not gone down well in the trade, because the ring-like sheet metal sieve has to have joins on the inner face of the drum wall which do not make it possible for smooth flow of the metal turnings to take place. While it is true that the sheet metal sieve may readily be changed over for a new one, the known centrifuge drum does have the shortcoming that the finely perforated sheet metal sieve quickly becomes stopped up and cleaning it is a generally complex operation.

A centrifuge for continuously freeing metal turnings of oil is produced by Machinenfabrik Gebr. Steimel having a bell-like centrifuge drum which is made in one piece and in the case of which the outlet openings for the liquid to be cleared from the turnings are formed by a number of lines of coned holes, which have their smallest diameter at the inner face of the centrifuge drum wall. In the case of this centrifuge drum as well cleaning with the more or less completely stopped up holes is a complex operation. For blowing material out of the holes, which may for example be placed in four planes, the known design of centrifuge has compressed air nozzles placed in the four planes so that the holes may be generally completely cleared by blowing. However, even with the coned design of the holes and the use of compressed air nozzles, the holes still become stopped up after the centrifuge have been used for some time because of oil materials and other sticky waste material, which becomes deposited and resin-like and makes its way into the holes. For this reason the holes have to be cleaned from time to time using a special pointed tool to get the waste material out. This work takes a long time. A further shortcoming of the known centrifuge drum is that there is heavy wear near the holes. Because of the abrasive effect of the metal turnings scratches and grooves are formed in the inner face of the centrifuge drum walls with the outcome that the turnings may not be smoothly taken from the drum and the centrifuging efficiency becomes less good.

One purpose of the present invention is that of designing a centrifuge drum for continuous centrifuges for turnings, which is free of the shortcomings, as noted, on the known centrifuge drum and is so designed that its oulet openings may be simply kept free, so that the liquid to be taken from the turnings may freely make its way out of the drum, furthermore the outlet openings may be cleaned while, furthermore, there is no wear of the drum at certain parts thereof.

This purpose is effected by using the structure as noted in claim 1.

The drum of the present invention gives the useful effect that for letting off the centrifuged liquid use is made of only one gap which may readily be cleaned by blowing into it with a compressed air nozzle and with the help of a scraper may readily be cleaned on moving round the drum. For this purpose use may be made of a normal sort of knife as for example a carpet knife. Because of the fact that the diameter of the lower edge at the inlet side of the gap is smaller than the diameter of the top edge at the inlet side of the gap, the metal turnings smoothly moving over the lower edge of the inlet of the gap are moved along a sort of chute, the metal turnings jumping, on moving from the lower end of the drum to the top edge thereof, over the gap so that there is no danger of them being kept hanging or hooked in the gap and causing wear at this position. The breadth of the gap at the inlet side thereof may be changed to the best possible size in view of the material to be treated by having the right size of spacers, for example spacer rings placed between the flanges of the lower and top parts of the drum. It is furthermore possible for the top drum part, whose inner wall face is upright or designed running inwardly at a slope and is used as a braking part for the metal turnings moving upwards, to be changed over to have the form needed for the material to be processed. The slope to the vertical of the inner wall face of the top drum part has to be greater on processing steel turnings than on processing aluminum turnings. If the lower drum parts are completely even, by changing over the top drum parts with different slopes to the inner wall face the centrifuging drum may be made to be fully in line with the needs of the material to be processed. The outcome of this is that producing and storing centrifuge drums will be as far as possible in full harmony with the nature of the material to be processed.

Further details of the invention will be seen from claims 2 to 10.

The account now to be given is of working examples of the invention using the figures so as to get further details.

Figure 1:
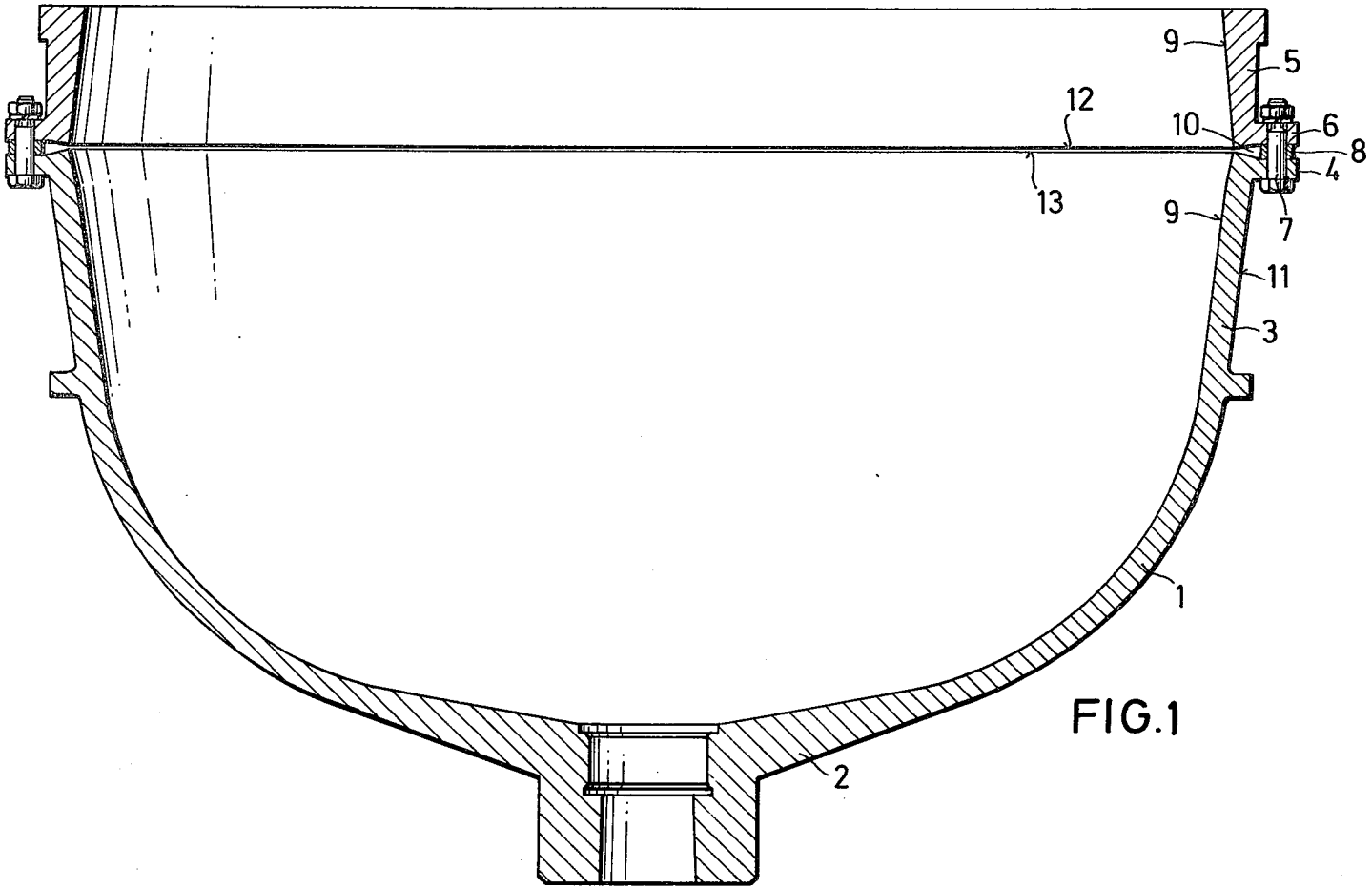
FIG. 1 is a vertical section through a centrifuge drum of the present invention.

The bell-like centrifuge drum to be seen in FIG. 1 may be fixed directly on an upright shaft and is made up of a lower drum part 1 with a drum floor 2 and a coned wall part 3, and of a top drum part 5 with a vertical or inwardly sloping inner wall face 9.

Figure 2:
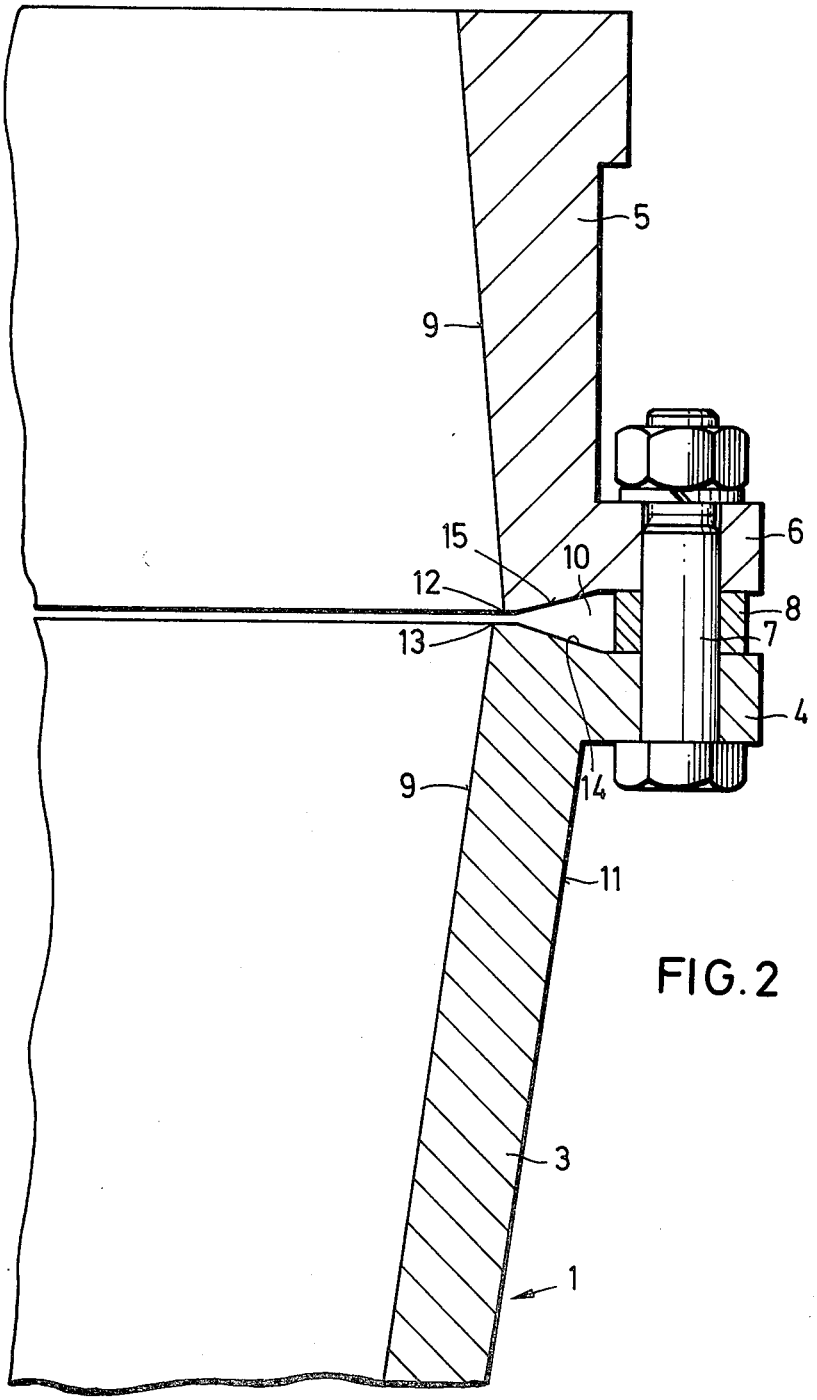
FIG. 2 is a view of part of FIG. 1 on a larger scale.
Figure 3:
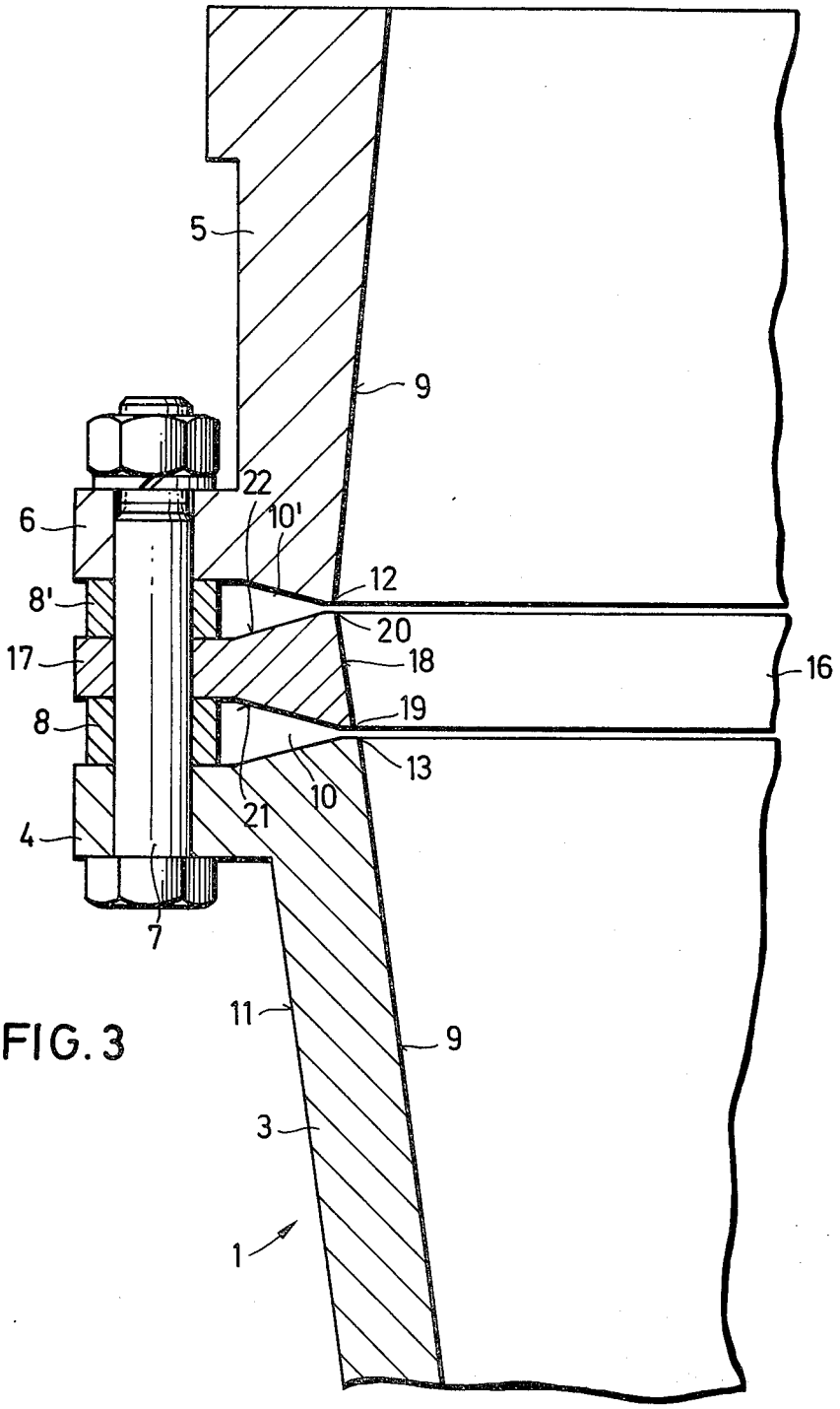
FIG. 3 is a view on the same lines as in FIG. 2 but in a somewhat changed form of the invention.

On the top edge of the lower drum part 1 there is an outwardly running flange 4 and on the lower edge of the top drum part 5 there is an outwardly running flange 6. These flanges 5 and 6 are screwed together with with spacers or spacer washers 8 therebetween by using keying screws 7 so that a gap 10 is in existence between the two halves, for letting off oil, to be centrifuged from the turnings, from the inner wall 9 of the drum in an outward direction, while the metal turnings are moved further and further upwards by the centrifugal force in the coned wall part 3 till they get to the top edge of the top drum part 5, where they make their way outwards away from the drum and are taken up in a condition free of oil. The top ring-like end face 14 of the lower drum part 1 is placed at a slope running downwards towards the outer face 11 of the drum wall and the lower, ring-like end face 15 of the top drum part 5 is sloped outwards in an upward direction so that the gap 10 has its narrowest point at the inner drum wall face 9 and its widest point at the outer face 11 of the drum wall. For forming the gap 10, which becomes wider in an outward direction, it is only necessary for one of the two end faces 14 and 15 to be at a slope in relation to the horizontal. The narrowest point of the gap 10 is formed by the lower edge 12 of the top drum part 5 and the top edge 13 of the lower drum part 1. As may be seen from FIG. 2, the sloping end faces 14 and 15 are designed running at a distance of two or three millimeters short of the inner face 9 fo the wall, into a horizontal face so that the edges 12 and 13 are not formed at an acute but at an obtuse angle. This design gives the useful effect that the centrifuge drum may be trued up at its inner wall face 9 without this making the breadth of the gap 10 any greater at the inner face 9 of the drum wall. Gap 10 is about 1 mm broad at its narrowest point, while the breadth of the gap 10 at the outer wall face 11 is about 9 mm. The slope angle of the two end faces 14 and 15 is equal to about ±15° to the horizontal. The clearance diameter of the lower edge 12 of the top part 5 of the drum is about 2 to 3 mm greater than the clearance diameter of the top edge 13 of the lower part 1 of the drum. The metal turnings, on their way upwards, for this reason come up against the edge 12 on the top part 5 of the drum. In the working example of FIG. 3 there are two gaps 10 and 10' which become wider in an outward direction and which are formed by a ring-like part 16 which is placed between the lower drum part 1 and the top drum part 5. The ring part 16 has its flange 17 which, by way of spacer washers 8 and 8', is spaced in relation to the flange 4 of the lower drum part 1 and the flange 6 of the top drum part 5. The inner wall 18 of the ring part 16 is at such a slope that its lower edge 19 has a greater diameter than the top edge 13 of the lower drum part 1 and its top edge 20 has a smaller diameter than the lower edge 12 of the top drum part 5. The lower end face 21 and the top end face 22 of the ring-like part 16 have the same angle to the horizontal but are sloped in opposite directions. Between the flanges 4, 17 and 6 of the lower drum part 1, of the ring-like part 16 and the top drum part 5 there are spacer rings 8 and 8' at the same height so that two gaps 10 and 10' of the same form are produced. In the working example of FIG. 3 the top end face of the lower drum part 1 and the lower end face of the top drum part 5 may furthermore be horizontal.

I claim:

1. A centrifuge drum for continuously freeing metal turnings of oil, comprising:

a hollow bottom drum having a floor and an open top portion, said open top portion having a top edge with a fixed diameter;

an outwardly running flange disposed on said top edge of said hollow bottom drum;

a hollw top drum having open bottom and top portions, said open bottom portion having a bottom edge with a fixed diameter, said hollow top and bottom drums having walls with inner and outer faces and have clearance diameters at said bottom and top edges of said hollow top and bottom drums respectively;

an outwardly running flange disposed on said bottom edge of said hollow top drum, said hollow top drum being removably mounted to said hollow bottom drum at said outwardly running flanges and forming a hollow interior which does not contain any other elements of the centrifuge drum and a circumferential gap between said outwardly running flanges about the periphery of said hollow top and bottom drums, so that the liquid cleared from the metal turnings can be discharged from the centrifuge drum, said gap being formed to completely extend through said walls of said hollow top and bottom drums by stretching from said inner faces of said hollow top and bottom drums and becoming conically wider at said outer faces of said hollow top and bottom drums, said clearance diameter of said lower edge of said gap at said inner face of said drum wall of said hollow top drum being greater than said clearance diameter of said top edge of said gap at said inner face of said drum wall of said hollow bottom drum; and means for rigidly securing said hollow top and bottom drums.

2. The centrifuge drum as defined in claim 1, wherein said hollow bottom drum has a top ring-like end face, said top ring-like end face being sloped downwardly in an outward direction.

3. The centrifuge drum as defined in claim 2, wherein said hollow top top drum has a lower end face, said lower end face being sloped upwardly in an outward direction.

4. The centrifuge drum as defined in claim 3, wherein the slope of said ring-like end faces of said hollow bottom and top drums terminate one to three millimeters short of said inner faces of said drum walls and then goes on as a horizontal face.

5. The centrifuge drum as defined in claim 4, wherein between said bottom drum part and said top drum part there is disposed a ring-like part, said ring-like part having a flange spaced from said outwardly running flange of said hollow bottom drum and said outwardly running flange of said hollow top drum part.

6. The centrifuge drum as defined in claim 2, wherein the slope of said ring-like end faces of said hollow bottom and top drums terminate one to three millimeters short of said inner faces of said drum walls and then goes on as a horizontal face.

7. The centrifuge drum as defined in claim 2, wherein between said bottom drum part and said top drum part there is disposed a ring-like part, said ring-like part having a flange spaced from said outwardly running flange of said hollow bottom drum and said outwardly running flange of said hollow top drum part.

8. The centrifuge drum as defined in claim 3, wherein the slope of said ring-like ends faces of said hollow bottom and top drums terminate one to three millimeters short of said inner faces of said drum walls and then goes on as a horizontal face.

9. The centrifuge drum as defined in claim 3, wherein between said bottom drum part and said top drum part there is disposed a ring-like part, said ring-like part having a flange spaced from said outwardly running flange of said hollow bottom drum and said outwardly running flange of said hollow top drum part.

10. The centrifuge as defined in claim 1, wherein between said bottom drum part and said top drum part there is disposed a ring-like part, said ring-like part having a flange spaced from said outwardly running flange of said hollow bottom drum and said outwardly running flange of said hollow top drum part.

11. The centrifuge drum as defined in claim 10, wherein said ring-like part has an inner wall face and lower and top edges, said inner wall face is disposed at such a slope that said lower edge has a greater diameter than said top edge of said hollow lower drum and said top edge has a smaller diameter than said lower edge of said hollow top drum.

12. The centrifuge drum as defined in claim 11, wherein said top end face and said lower end face of said ring-like part are at generally the same angle but are sloped in opposite directions.

13. The centrifuge drum as defined in claim 10, further comprising spacer rings disposed between said outwardly running flange of said hollow top drum and said flange of said ring-like part and between said flange of said ring-like part and said outwardly running flange of said hollow bottom drum.

14. A centrifuge drum for continuously freeing metal turnings of oil, comprising:

a hollow bottom drum having a floor and an open top portion, said open top portion having a top edge with a fixed diameter;

an outwardly running flange disposed on said top edge of said hollow bottom drum;

a hollow top drum having open bottom and top portions, said open bottom portion having a bottom edge with a fixed diameter;

an outwardly running flange disposed on said bottom edge of said hollow top drum, said hollow top drum being removably mounted to said hollow bottom drum at said outwardly running flanges and forming a hollow interior which does not contain any other elements of the centrifuge drum and a circumferencial gap between said outwardly running flanges about the periphery of said hollow top and bottom drums, so that the liquid cleared from the metal turnings can be discharged from the centrifuge drum, said hollow drums each having an inner wall, said inner wall of said hollow bottom drum having a diameter increasing from below upwardly up to said upper edge so that an imaginary line which is a continuation of said inner wall of said hollow bottom drum crosses said inner wall of said hollow top drum in a point which is located above said lower edge and has a smaller diameter than the latter means for rigidly securing said hollow top and bottom drums.

* * * * *